US010183801B2

(12) United States Patent
Maalouf et al.

(10) Patent No.: US 10,183,801 B2
(45) Date of Patent: Jan. 22, 2019

(54) SHEET PACKAGE ASSEMBLY AND METHOD FOR MAKING THE SAME

(71) Applicant: Medline Industries, Inc., Mundelein, IL (US)

(72) Inventors: Sharbel Maalouf, Pleasant Prairie, WI (US); Chris Mallon, Grayslake, IL (US); Lorie Rowe, McHenry, IL (US)

(73) Assignee: Medline Industries, Inc., Northfield, IL (US)

( * ) Notice: Subject to any disclaimer, the term of this patent is extended or adjusted under 35 U.S.C. 154(b) by 26 days.

(21) Appl. No.: 14/518,729

(22) Filed: Oct. 20, 2014

(65) Prior Publication Data

US 2016/0107822 A1 Apr. 21, 2016

(51) Int. Cl.

*B65D 83/08* (2006.01)
*B65B 61/20* (2006.01)
*B65B 25/14* (2006.01)

(52) U.S. Cl.

CPC ..... *B65D 83/0805* (2013.01); *B65B 25/145* (2013.01); *B65B 61/20* (2013.01); *B65D 83/0888* (2013.01); *B65D 83/0894* (2013.01); *B65B 2220/14* (2013.01); *B65D 2313/08* (2013.01)

(58) Field of Classification Search

CPC ..... B65D 83/0805; B65D 83/0894; B65D 2313/08; B65D 83/0888; B65B 61/20
USPC ..... 206/223, 449, 494, 210, 233; 53/445
See application file for complete search history.

(56) References Cited

U.S. PATENT DOCUMENTS 2,906,478 A * 9/1959 Merrick ..... B65B 67/1227 248/95
3,133,690 A * 5/1964 Lui ..... B60N 3/08 383/106
3,307,687 A * 3/1967 Steinman ..... A47K 10/421 206/229
3,333,686 A * 8/1967 Schnabel ..... A47K 10/421 206/223
3,873,735 A * 3/1975 Chalin ..... B65D 75/58 206/459.5
4,610,357 A * 9/1986 Nakamura ..... B65B 9/073 206/449
4,706,297 A * 11/1987 Ausnit ..... B65D 33/2566 383/122

(Continued)

OTHER PUBLICATIONS

YouTube video "Feminine Hygiene Disposal" by S.A.C. Published Jun. 4, 2013. link: https://www.youtube.com/watch?v=pB0JzCIUVt8. Screenshot of 1:10 provided in rejection.*

(Continued)

*Primary Examiner* — Steven A. Reynolds
(74) *Attorney, Agent, or Firm* — Philip H. Burrus, IV

(57) ABSTRACT

A sheet package assembly (100) includes a plurality of sheets (301) arranged in a stacked configuration (302). The package can include an outer surface (102) having a major face (103) defining an aperture (201). An aperture sealing label (106) can selectively attach to the outer surface to close the aperture, and can be selectively peelable from the outer surface to expose the aperture. A bag (306) IS to receive spent sheets for disposal. The plurality of sheets is arranged in the stacked configuration (307) within the package, while the bag is positioned between the stacked configuration and the aperture of the package.

14 Claims, 10 Drawing Sheets

(56) References Cited

U.S. PATENT DOCUMENTS

| | | | | |
|---|---|---|---|---|
| 4,739,879 | A * | 4/1988 | Nakamura | B65B 61/184 206/205 |
| 5,409,116 | A * | 4/1995 | Aronsen | B65B 5/022 206/484 |
| 5,688,394 | A * | 11/1997 | McBride, Jr. | B65D 83/0805 134/40 |
| 5,791,465 | A | 8/1998 | Niki et al. | |
| 6,848,595 | B2 * | 2/2005 | Lange | A47K 10/421 206/494 |
| 7,007,801 | B2 | 3/2006 | Mangold et al. | |
| 7,344,022 | B2 * | 3/2008 | Madson | B65D 33/25 206/205 |
| 2001/0034904 | A1 | 11/2001 | Phillips et al. | |
| 2004/0144796 | A1 | 7/2004 | Wang et al. | |
| 2004/0200751 | A1 * | 10/2004 | Coonan | B65D 83/0805 206/494 |
| 2007/0235352 | A1 * | 10/2007 | Madson | B65D 33/25 206/226 |
| 2011/0158565 | A1 * | 6/2011 | Hellming | B65D 31/12 383/203 |
| 2013/0206640 | A1 * | 8/2013 | Mann, Jr. | A45C 11/008 206/581 |
| 2013/0270150 | A1 | 10/2013 | Bahcall | |
| 2016/0015388 | A1 * | 1/2016 | Ren | A61B 17/06161 383/33 |

OTHER PUBLICATIONS

"ReadyBath Evolve Bathing Cloths", Medline Catalog; https://www.medline.com/catalog/catalog.jsp; Unknown Publication Date but believed to be prior to filing of present application,.

"ReadyBath Fresh Standard-Weight Bathing Cloths", Medline Catalog; https://www.medline.com/catalog/catalog.jsp; Unknown Publication Date but believed to be prior to filing of present application,.

"ReadyBath LUXE Total Body Cleansing Heavyweight Washcloths", Medline Catalog; https://www.medline.com/catalog/catalog.jsp; Unknown Publication Date but believed to be prior to filing of present application,.

"ReadyBath Rinse-Free Shampoo and Conditioning Caps", Medline Catalog; https://www.medline.com/catalog/catalog.jsp; Unknown Publication Date but believed to be prior to filing of present application,.

"ReadyBath Select Medium Weight Cleansing Washcloths", Medline Catalog; https://www.medline.com/catalog/catalog.jsp; Unknown Publication Date but believed to be prior to filing of present application,.

"ReadyBath Total Body Cleansing Standard Weight Washcloths", Medline Catalog; https://www.medline.com/catalog/catalog.jsp; Unknown Publication Date but believed to be prior to filing of present application,.

* cited by examiner

SHEET PACKAGE ASSEMBLY AND METHOD FOR MAKING THE SAME

BACKGROUND

Technical Field

This disclosure relates generally to sheet devices, and more particularly to packaged sheet devices.

Background Art

Manufacturers of personal care products manufacture cloth wipes and other sheet devices for personal hygiene of individuals. For example, wipes and other cloths can be used in a health care setting for cleaning the skin and for dealing with incontinence care. Runners, athletes, and other active individuals may use such wipes and cloths to freshen up after exercise when showers or bathing facilities are unavailable.

Such wipes are often disposable. Some wipes are designed to breakdown and disperse after use while others are substantially non-dispersible. This non-dispersible property allows them to be used with water during patient cleaning. Additionally, the non-dispersible property allows some cloths to be pre-moistened with rinse-free fluids that clean, moisturize, condition and soothe the skin.

Since they are frequently designed as "single use" items, and as they are frequently used for cleaning patient waste, some users may attempt to dispose of these sheets by flushing them down the toilet. For dispersible products, such as toilet paper, this is not a problem since the water in the toilet breaks down their materials. However, for non-dispersible sheets, accumulation in the trapway or other parts of a toilet can lead to a variety of problems, including stoppage of the toilet, blockage of the exhaust system leading away from the toilet, malfunction of septic tanks or sewage systems, or other maladies.

It would be advantageous to have a system to reduce these problems.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
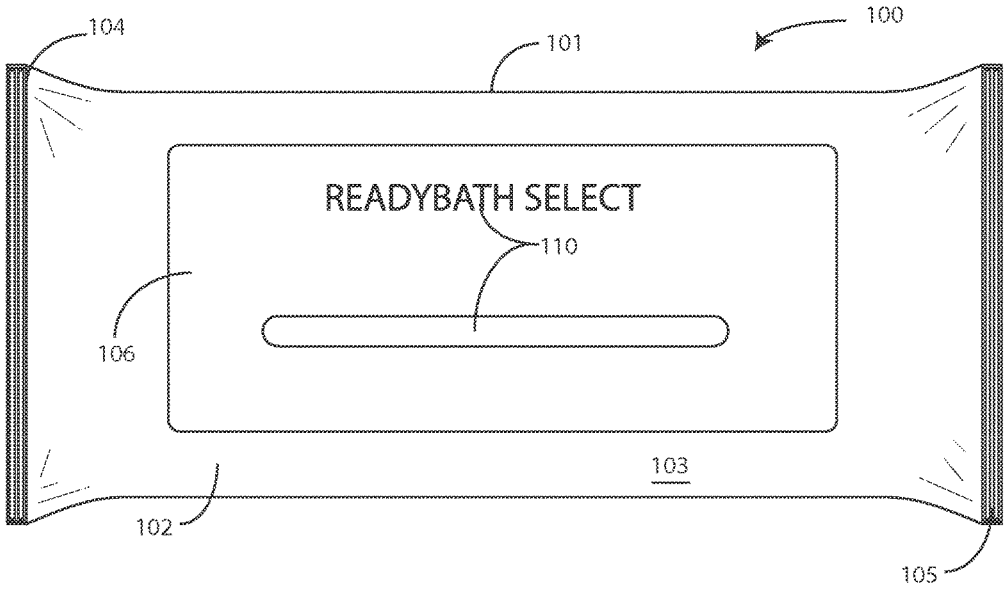
FIG. 1 illustrates one explanatory package assembly in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Prior art attempts at solving the problems described above have been cumbersome, expensive, and difficult to use. For example, U.S. Pat. No. 8,201,281 to Hanifl et al., incorporated herein by reference, discloses a trapping device for non-dispersible cloths. In the '281 patent, a trapping device involves wrapping a metal strap into a circle. The strap must then be permanently installed into the trapway of a toilet bowl with a screw. A staple leg, which is a bent piece of strap metal, then attempts to catch non-dispersible cloths about its perimeter, while allowing other materials to pass through.

In practice, the strap of the '281 patent has problems. First, a specialized technician must permanently install the strap. Next it requires a special sizing tool to form the strap to the proper size. Once installed, a person must reach into the water with a special set of pliers to remove a protective foam ring. Each of these steps is very user-unfriendly. The steps are also costly and time consuming.

The foremost problem with the strap of the '281 patent is that when non-dispersible cloths are captured, a user must reach into the bowl with a retriever to "unsnag" the non-dispersible cloths from the strap. This is a tedious chore, can result in the user actually pushing the non-dispersible cloth further into the trapway or into the exhaust completely, and requires the user to place their hands in an unsanitary position.

Embodiments of the disclosure provide a simpler, less expensive, faster, and more user-friendly assembly for preventing non-dispersible sheets from being flushed down the toilet. In one embodiment, a sheet package assembly includes a plurality of sheets arranged in a stacked configuration. The stack of sheets is placed within a package. In one embodiment, the package defines an outer surface having a major face defining an aperture through which individual sheets can be drawn. An aperture sealing label can then be attached to the package to conceal the aperture. In one embodiment, the aperture sealing label is to selectively attach to the outer surface to close the aperture. In one embodiment, the aperture sealing label is also selectively peelable from the outer surface to expose the aperture.

To preclude sheets from being flushed down the toilet, in one embodiment the package also includes a bag to receive spent sheets for disposal. To ensure that the user sees the bag when opening the package, in one embodiment the bag is positioned between the aperture and the stacked configuration of the sheets. Accordingly, when a user peels back the aperture sealing label, the first thing exposed through the aperture is a portion of the bag. In one embodiment, the user must withdraw the bag to be able to access the stacked configuration of sheets. Thus, in one or more embodiments, the plurality of sheets is arranged in the stacked configuration within the package and the bag is positioned between the stacked configuration and the aperture of the package.

In one embodiment, the bag is sealable. For example, in one embodiment the bag includes a zip-strip or an adhesive closure permitting the bag to be sealed after spent sheets are placed within the bag.

In one embodiment, the sealable bag has written indicia disposed along an outer surface of the sealable bag. For example, in one embodiment, the bag comprises written instructions for using the bag disposed thereon. The written instructions may comprise an instruction not to flush the sealable bag down a toilet. In one embodiment, the instruction is "DO NOT FLUSH" written in large, bold letters along the outer surface of the bag.

As noted above, by disposing the bag between the stacked configuration of sheets and the aperture, a user is required to withdraw the bag from the package first, i.e., prior to accessing the sheets. Advantageously, when this occurs the user is given a solution for avoiding disposal of the sheets down the toilet. Moreover, where the bag includes written instructions for using the bag, the user is provided with a written protocol instructing the user how to properly dispose of the spent sheets. The inclusion of the bag within the package ensures that spent sheets are not disposed by flushing, but are instead disposed in a contained and hygienic fashion.

Embodiments of the disclosure provide the following advantages with respect to the proper disposal of non-dispersible sheets: First, the inclusion of the bag provides the user with a disposal solution that prevents spent sheets from being flushed. Second, inclusion of the bag in the package improves compliance and standardization with respect to how spent sheets should be disposed. Third, inclusion of the bag in the package improves infection control by assuring that spent sheets are disposed within a, in one embodiment, sealed bag. Fourth, inclusion of the bag within the package offers a printed disposal solution protocol that is readily available to users. Fifth, inclusion of the bag within the package helps prevent harm and damage to plumbing systems when spent sheets are flushed. Other advantages will be obvious to those of ordinary skill in the art having the benefit of this disclosure.

In other embodiments of the disclosure, the bag can be attached to the outside of the package. Said differently, in one embodiment the bag can be affixed to the rear side or front side of the package. Accordingly, once a sheet is spent, it can easily be disposed of into the bag extending from the package. Since the bag is exposed from the package at the point of use, correct disposal of the spent sheet is more likely to occur. Where the bag is attached to an outer surface of the package, the package can—in one embodiment—include instructions indicating that spent sheets should be placed within the bag.

When using such an embodiment, a user opens whatever closure seals an aperture of the housing. A user also extends the bag, which may initially be folded against the outer surface of the package, from the package. They withdraw a sheet from the aperture and use it. Once the sheet is spent, they deposit the spent sheet within the bag. The bag is ultimately disposed of in a trash can to leave a clean smelling environment.

Figure 2:
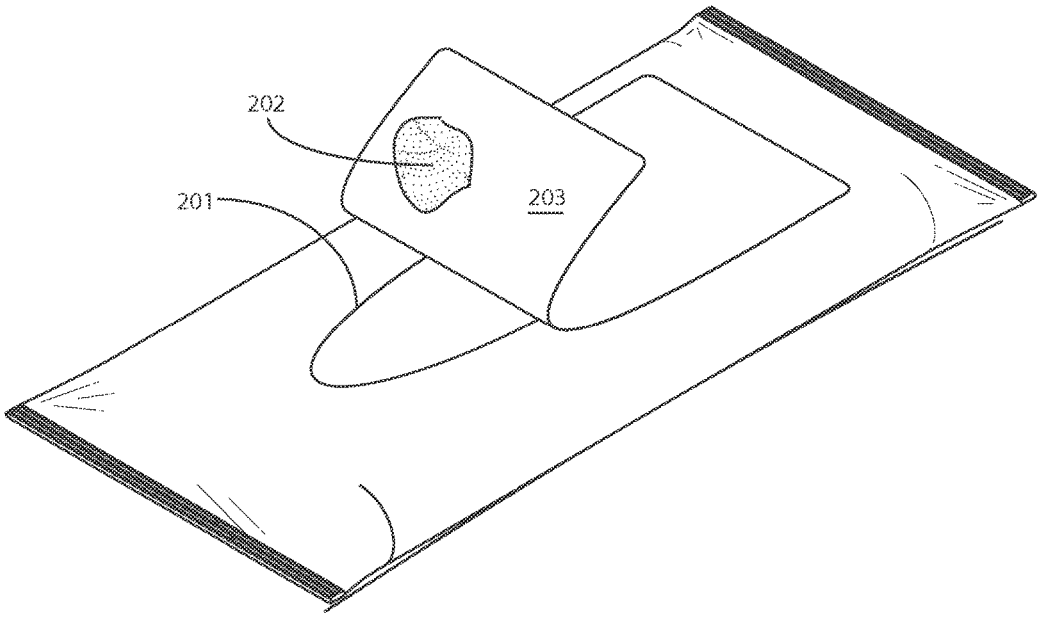
FIG. 2 illustrates an explanatory package assembly in accordance with one or more embodiments of the disclosure.

Turning now to FIGS. 1 and 2, illustrated therein is one explanatory sheet package assembly 100 in accordance with one or more embodiments of the disclosure. In one embodiment, the sheet package assembly 100 includes a package 101 comprising an outer surface 102. In one embodiment, the outer surface 102 defines a major face 103 forming the top of the package 101. A second major face (not shown in FIG. 1) defines the bottom of the package 101, while one or more minor faces define the sides of the package.

The package 101 can have one or more ends 104,105 that are sealed to define an interior compartment, which will be shown in more detail below with reference to FIG. 3. In one embodiment, the ends 104,105 are thermally sealed together. Other closure techniques can be used, including fusing, crimping, or bonding.

In one embodiment, the package 101 can be manufactured from a flexible film that is thermoplastic-based, foil based, or is another type of flexible material. In one or more embodiments, the package 101 is manufactured from a material that is not permeable to moisture. As will be explained in more detail below, in one or more embodiments, the package 101 can be used to enclose a stacked configuration of sheets. The sheets can be pre-moistened in some use cases. A non-permeable material, such as polyester, polypropylene, polycarbonate, polyvinylidene fluoride, cellophane, polymethyl metacrylate, polystyrene, ethylene acrylic acid, polyvinyl chloride, acetate fiber, single or multi laminated films, or a combination thereof, can prevent the loss of moisture from the pre-moistened sheets. Other suitable materials include metallic foils, synthetic fiber materials, coated materials, lined materials, and so forth. The package 101 can be manufactured from one or more layers as well. In still other embodiments, the package 101 can be manufactured from a rigid material, such as a thermoplastic or metal as well. Other packaging configurations will be obvious to those of ordinary skill in the art having the benefit of this disclosure.

In one embodiment, the package 101 is substantially rectangular when viewed in plan view as shown in FIG. 1. However, it should be noted that the package 101 may be any shape, including square, oval, circular, free-form shapes, or any other desired shape.

In one embodiment, a closure is attached to the outer surface 102 of the package 101. In this embodiment, since the package 101 is manufactured from a flexible material, the closure is in the form of an aperture sealing label 106 that is attached to the outer surface 102 along the major face 103 of the package 101. Had the package 101 been manufactured from a rigid material, the closure could have been a lid or other closure. Additionally, while the centrally disposed location along the major face 103 of the outer surface 102 of the package 101 is one possible location for the aperture sealing label 106, the aperture sealing label 106 can be disposed at other locations as well.

As best shown in FIG. 2, in one embodiment the outer surface 102 of the package 101 defines an aperture 201. The aperture 201 provides an opening to the interior compartment. As will be described in more detail below, in one embodiment a plurality of sheets are arranged in a stacked configuration and are disposed within the interior compartment. In such a configuration, the sheets can be drawn from the package 101 through the aperture 201.

In one embodiment, the aperture 201 is cut into the package 101. In other embodiments, the package 101 can be scored or perforated, thereby requiring a user to tear the package along the score or perforation line to open the aperture 201. It should be noted that the aperture may be any desired shape and/or size, including the ovular shape shown in FIG. 2. In one or more embodiments, the aperture 201 is defined by abutting or overlapping edges of the package 101 that are not attached together.

In one embodiment, the aperture sealing label 106 is attached to the outer surface 102 of the package 101 so as to cover and close the aperture 201. As shown in FIG. 1, the aperture sealing label 106 is attached to the major face 103 of the outer surface 102 of the package 101 so as to cover, conceal, and close the aperture 201. However, as shown in FIG. 2, when the aperture sealing label 106 is peeled back, the aperture 201 is exposed.

In one embodiment, the aperture sealing label 106 comprises printed indicia 110 disposed thereon. The printed indicia 110 can include branding or other information identifying that a plurality of sheets are disposed within the package 101. In one embodiment, the printed indicia 110 include a statement identifying that a disposal receptacle for the sheets is included within the package 101. In still other embodiments, the printed indicia 110 include instructions for using the contents of the package 101. Other information suitable for inclusion within the printed indicia 110 will be obvious to those of ordinary skill in the art having the benefit of this disclosure.

In one or more embodiments, the aperture sealing label 106 is selectively attachable to, and peelable from, the outer surface 102 of the package 101. In one embodiment, the aperture sealing label 106 is attached to the package 101 such that it can be lifted and resealed repeatedly without damaging the package 10. For example, in one embodiment, the aperture sealing label 106 has a releasable adhesive 202 disposed on the bottom side 203 of the aperture sealing label 106 so that it can selectively attach to, or be peeled from, the outer surface 102 of the package 101. In one or more embodiments, the aperture sealing label 106 is to an aperture sealing label 106 to selectively attach to the outer surface 102 to close the aperture 201, and to be selectively peelable from the outer surface 102 to expose the aperture 201.

It should be noted that a different type of closure could be used where the container is manufactured from a different material. Whether the closure is an aperture sealing label 106, a lid, a flip-top, a press-on snap-fit closure, or other type of closure, the closure functions to selectively open allow a user to remove contents from the package 101 through the aperture 201, and in one or more embodiments, be reclosable to cover and/or conceal the aperture 201. Thus, the closure serves as a resealing device to seal the aperture 201 in one or more embodiments.

Figure 3:
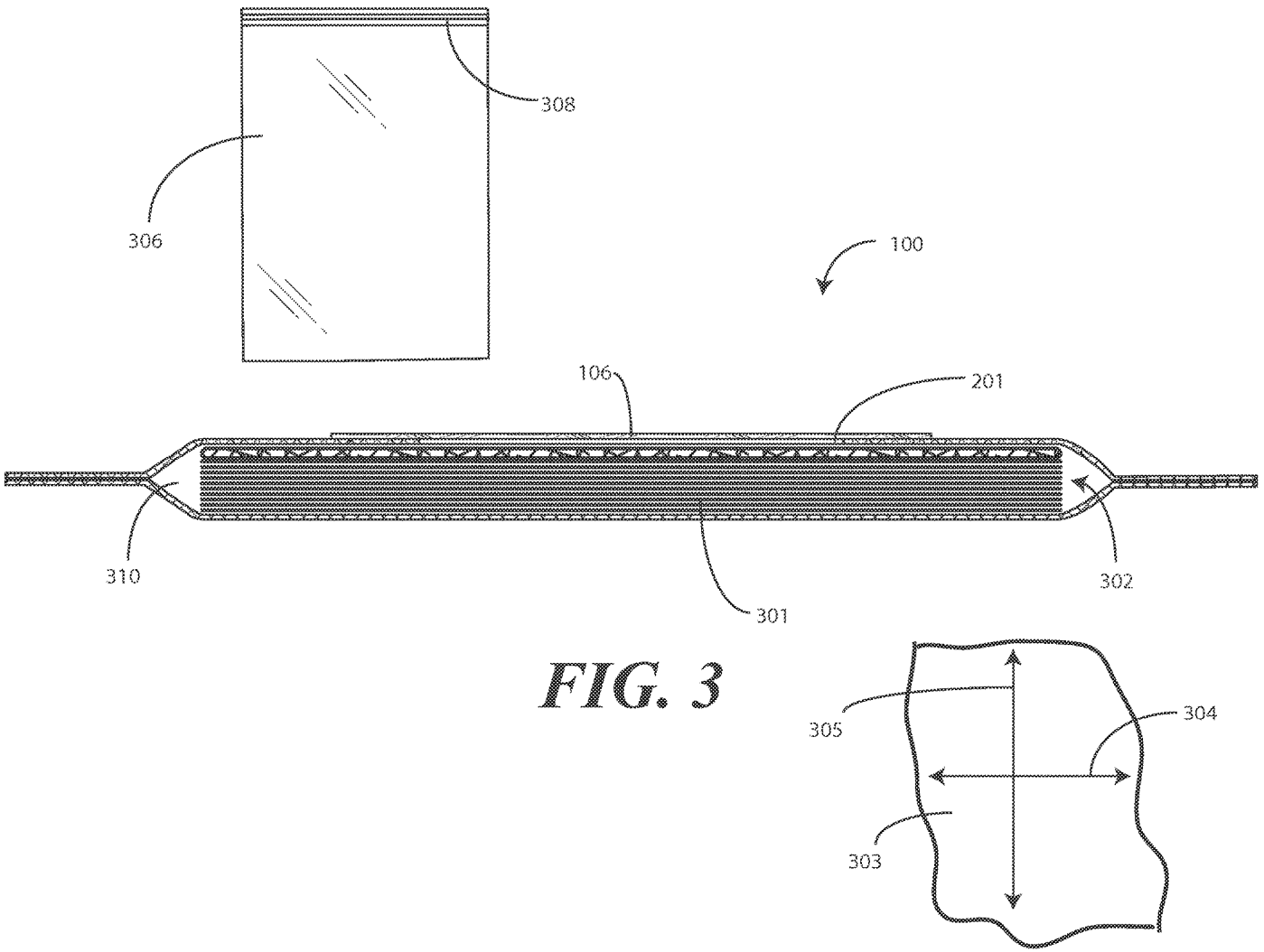
FIG. 3 illustrates a sectional view of one explanatory package assembly in accordance with one or more embodiments of the disclosure.

Turning now to FIG. 3, a sectional view of the sheet package assembly 100 is shown. In one embodiment, a plurality of sheets 301 arranged in a stacked configuration 302. While non-dispersible sheets manufactured from needlepunched or spunlace material will be used in one explanatory environment, embodiments of the disclosure are not so limited. Embodiments of the disclosure can be extended for use with diapers, briefs, under pads, and other items, each of which can be substituted for the plurality of sheets.

The plurality of sheets 301 can be manufactured from an organic, inorganic, or blended organic/inorganic material. For example, in one embodiment, the each sheet 303 is a non-dispersible sheet manufactured from a needle-punched material. Examples of non-dispersible sheets include needlepunched and spunlace sheets. Examples of such sheets are marketed by Medline Industries under the names Ready-Bath™ and AloeTouch™. These non-dispersible sheets can be configured as soft, single patient use, spunlace or needlepunched wipes that are quite gentle on the skin. Such non-dispersible sheets are versatile and convenient for use as wipes for everyday cleaning and incontinence care.

In one or more embodiments, the non-dispersible sheets are pre-moistened with rinse-free formula that cleans, moisturizes and soothes the skin. In one or more embodiments, the non-dispersible sheets can be pH-balanced for patient use, can be hypoallergenic, and alcohol free. In one or more embodiments, the non-dispersible sheets can be provided with a light, gender-neutral scent or, alternatively, free of fragrance.

In other embodiments, each sheet 303 can be manufactured from other materials. In some embodiments, for example, the plurality of sheets 301 can be manufactured from cloth or synthetic material. The plurality of sheets 301 can be dry, or alternatively pre-moistened with water or other solutions. Examples of moistening solutions include moisturizers, cleaning solutions, deodorizers, solvents, disinfectants, medications, skin care products, insect repellants, fragrances, and so forth. In one or more embodiments, the plurality of sheets 301 is manufactured from a material that is strong enough to prevent ripping or tearing of each sheet 303 during normal anticipated use.

It should be noted that the plurality of sheets 301 can take any of a variety of shapes and sizes. In one embodiment, each sheet 303 measures about eight inches square. The term "about" is intended to describe a dimension inclusive of manufacturing tolerances. Accordingly, a dimension of "about 8.11 inches" having a manufacturing tolerance of plus or minus 0.10 inches can be between 8.01 inches and 8.21 inches, inclusive.

In one embodiment, each sheet 303 is a non-dispersible sheet having a width 304 of between five and eight inches. In one embodiment, the non-dispersible sheets have a length 305 of between seven and twelve inches. Examples of sizes of the non-dispersible sheets include 5.5"×7.25", 8"×8", and 8"×12". These dimension examples are illustrative only, as others will be obvious to those of ordinary skill in the art having the benefit of this disclosure.

The number of sheets in the plurality of sheets 301 can vary as well. In one embodiment, the plurality of sheets 301 includes only two sheets. In another embodiment, the plurality of sheets 301 includes three sheets. In yet another embodiment, the plurality of sheets 301 includes eight sheets. In still another embodiment, the plurality of sheets 301 includes twenty-four sheets. Other numbers of sheets will be obvious to those of ordinary skill in the art having the benefit of this disclosure. Where, for example, briefs are substituted for the plurality of sheets, there may only be a single unit in the package. One pair of briefs may be included with one bag, such that the package, bag, and spent briefs can all be disposed as a single unit. It should be noted that each sheet 303 could be of any of a number of colors. Additionally, each sheet 303 could have visible indicia disposed thereon.

In one or more embodiments, to provide a disposal receptacle for spent sheets, which works to prevent spent sheets from being flushed down the toilet, the sheet package assembly 100 includes a bag 306 to receive spent sheets. The bag 306 can be any of a variety of types of bags. In one embodiment, the bag 306 is a disposable plastic bag. In other embodiments, the bag 306 can be a disposable biodegradable bag. In still other embodiments, the bag 306 can be manufactured from a material configured, for example, for disposal by incineration or other methods. The bag 306 can be clear in one or more embodiments. However, in other embodiments, the bag 306 is opaque so that spent sheets deposited within the bag 306 are not visible from the outside of the bag 306. Advantageously, use of an opaque material keeps soiled sheets, which may be unsightly, concealed from view when they are placed within the bag 306.

In one embodiment, the bag 306 is a sealable bag. For example, in one embodiment the bag 306 includes a closure 308 allowing the bag 306 to be sealed. In one embodiment, the closure 308 is a zip-strip closure. For example, the bag 306 can comprise a zip lock bag. In another embodiment, the closure 308 is an adhesive closure. In still other embodiments, the closure 308 can be omitted. Advantageously, including the closure 308 allows the bag 306 to be sealed once spent sheets are deposited within the bag 306 to facilitate a more hygienic disposal thereof.

In one embodiment, to make sure that the bag 306 is the first thing drawn through the aperture 201 when the aperture sealing label 106 is peeled away to reveal the aperture 201, the bag 306 is positioned between the stacked configuration 302 of the plurality of sheets 301 and the aperture 201 within an interior compartment 310 of the package 101. Said differently, in one embodiment the plurality of sheets 301 is arranged in the stacked configuration 302 and are positioned in the interior compartment 310 within the package 101. Thereafter, the bag 306 is positioned between the stacked configuration 302 and the aperture 201 within the interior compartment of the package 101. Each of the bag 306 and the plurality of sheets 301 is then withdrawable from the interior compartment 310 of the package 101 through the aperture 201. Since the bag 306 is positioned on top of the stacked configuration 302, when the aperture sealing label 106 is peeled away to reveal the aperture 201, the first thing the user sees is at least a portion of the bag 306. Thus, in one embodiment, a user is prevented from accessing the plurality of sheets 301 until the bag 306 is removed from the package 101 through the aperture 201. This configuration advantageously requires the user to see the bag 306 before accessing anything else in the interior compartment 310 of the package 101. This will be shown in more detail in FIGS. 4-6 below.

Figure 4:
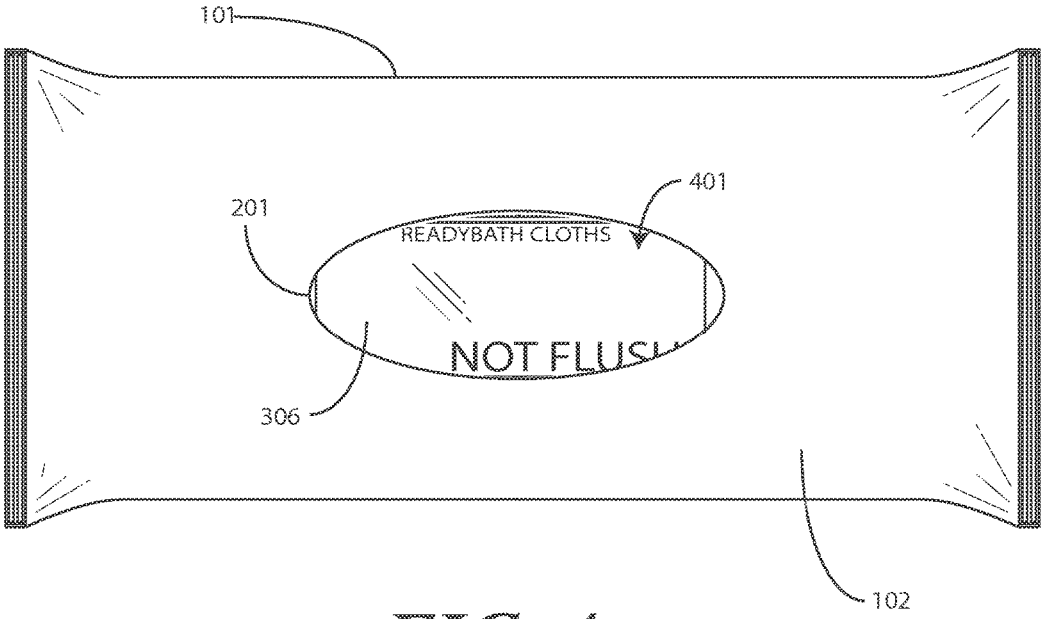
FIG. 4 illustrates one explanatory assembly in accordance with one or more embodiments of the disclosure.

Beginning with FIG. 4, the aperture sealing label (106) is shown as being removed for increased visibility of the aperture 201. However, in actual operation many users will simply peel the aperture sealing label (106) will be partially peeled from the outer surface 102 of the package 101 to reveal the aperture 201 as shown in FIG. 2.

In one embodiment, due to the fact that the bag 306 is positioned between the stacked configuration (307) of the plurality of sheets (301) and the aperture 201 within the interior compartment (310) of the package 101, when the aperture sealing label (106) is peeled from the outer surface 102 to expose the aperture 201, at least a portion 401 of the bag 306 is visible through the aperture 201. This is shown in FIG. 4.

Figure 5:
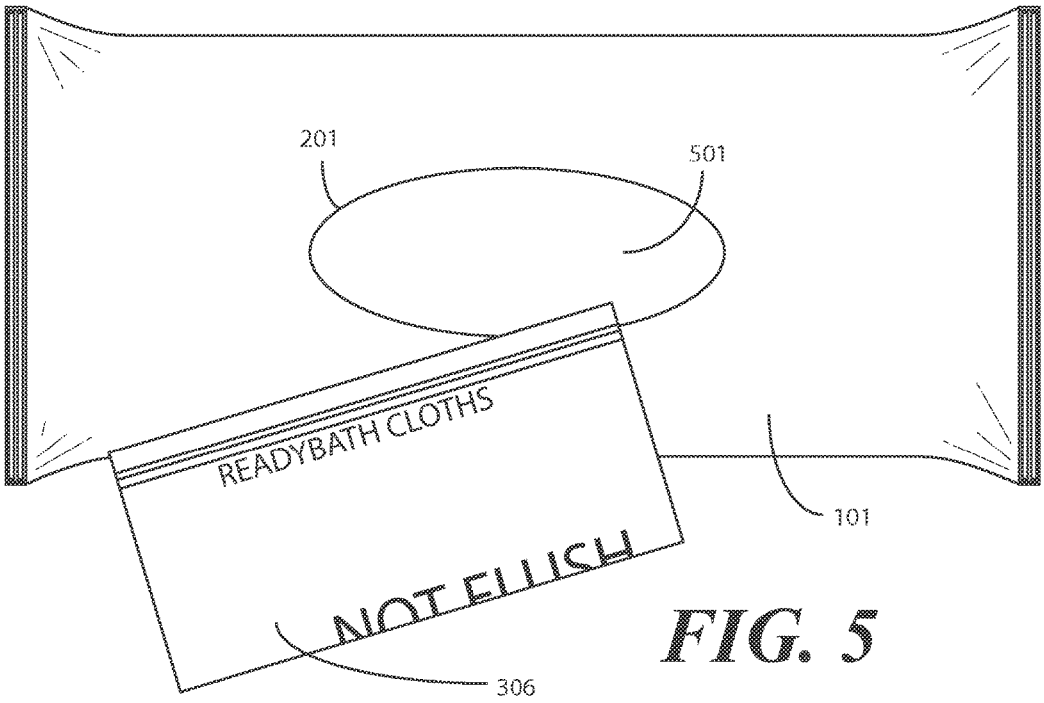
FIG. 5 illustrates one explanatory assembly in accordance with one or more embodiments of the disclosure.

Turning now to FIG. 5, a user has drawn the bag 306 through the aperture 201 to remove it from the package 101. As shown, in one embodiment the bag 306 is folded when in the package 101, and thus will need to be unfolded after removal from the package. When the bag 306 is removed from the package 101, the stacked configuration (307) of the plurality of sheets (301) is revealed through the aperture 201. More specifically, a portion of the uppermost sheet 501 is visible through the aperture 201. A user can now access the uppermost sheet 501 and remove it from the package 101 through the aperture 201.

Figure 6:
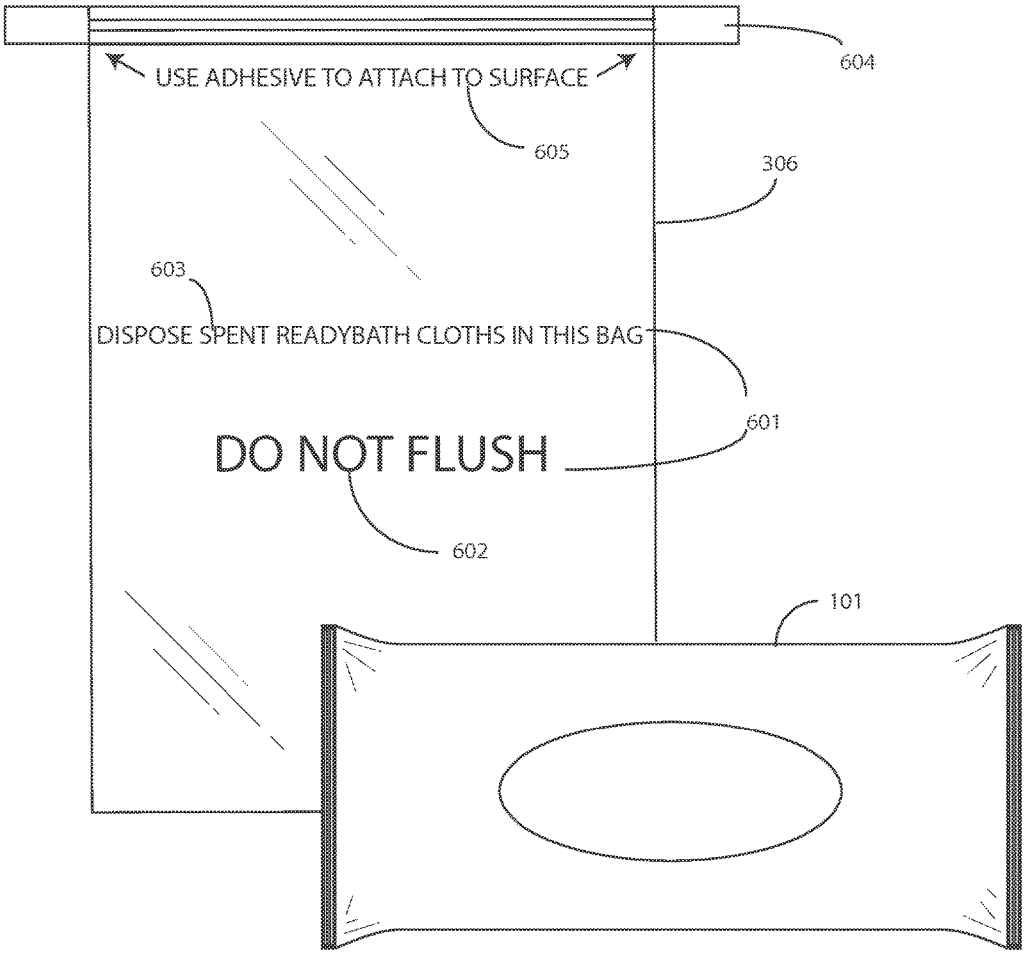
FIG. 6 illustrates one explanatory assembly in accordance with one or more embodiments of the disclosure.

Turning now to FIG. 6, the bag 306 has now been unfolded and can be used to receive spent sheets. As shown in FIG. 6, in one embodiment the bag 306 comprises written instructions 601 for using the bag 306 disposed thereon. For example, the written instructions 601 can be printed, silk screened, or otherwise disposed along an outer surface of the bag 306. In other embodiments, the written instructions 601 can be disposed on a sticker or label that is placed along the outer surface of the bag 306. Other methods of disposing the written instructions 601 on the bag 306 will be obvious to those of ordinary skill in the art having the benefit of this disclosure.

In one embodiment, the written instructions 601 comprise an instruction 602 not to flush the bag 306 down a toilet. For example, in one embodiment the instruction 602 reads, "DO NOT FLUSH." Other instructions will be obvious to those of ordinary skill in the art having the benefit of this disclosure.

Other instructions may be included as well. In one embodiment, the written instructions 601 further comprise an instruction 603 to dispose spent sheets within the bag 306. Such an instruction 602 may read, "DISPOSE CLOTHS IN THIS BAG." Other instructions will be obvious to those of ordinary skill in the art having the benefit of this disclosure.

Figure 7:
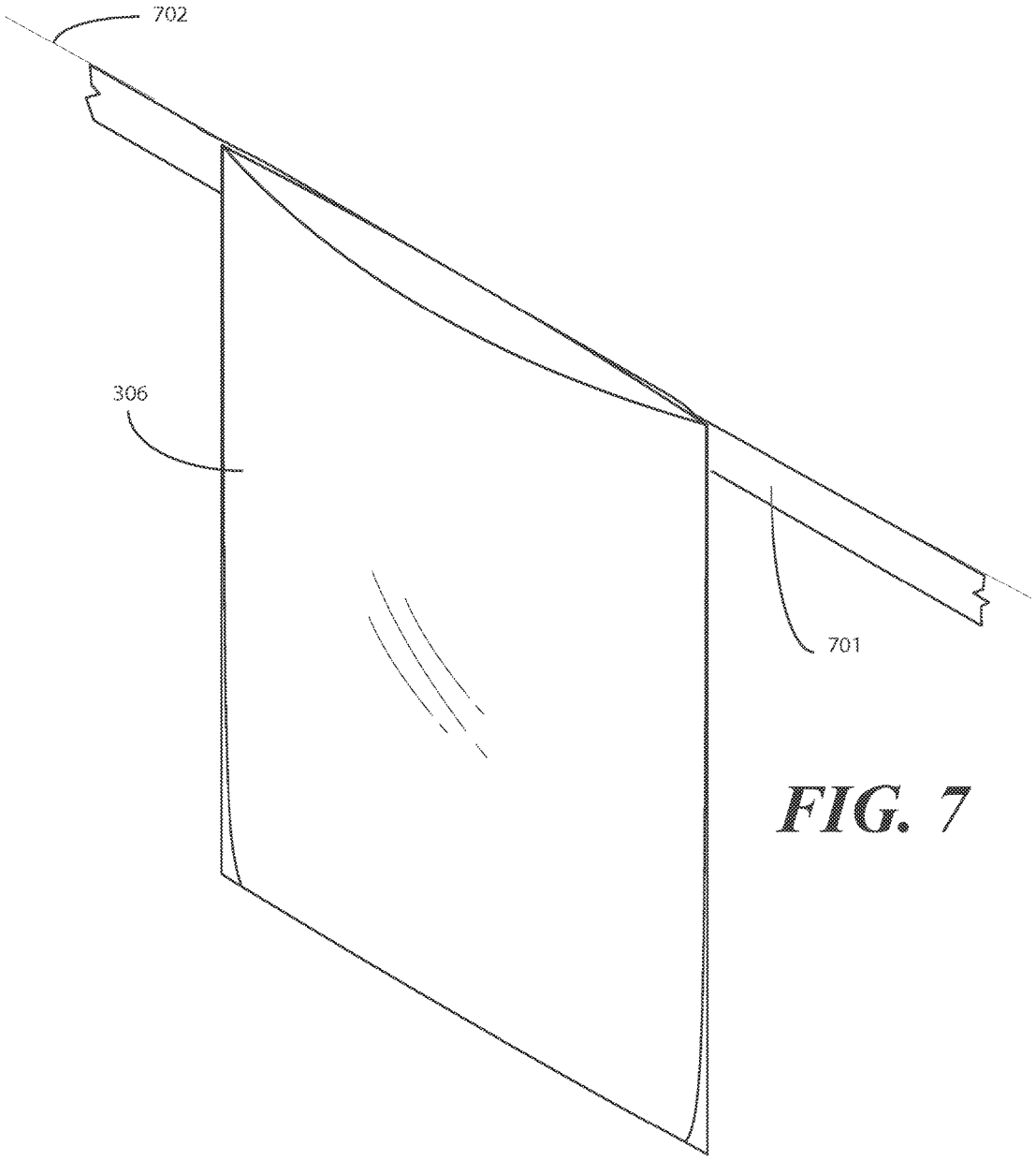
FIG. 7 illustrates one explanatory assembly in accordance with one or more embodiments of the disclosure.

In one or more embodiments, the bag 306 may comprise an attachment device 604 that can be used to couple the bag 306 to a surface. For example, in one embodiment the attachment device 604 comprises an adhesive tape. As shown in FIG. 7, the adhesive tape 701 can be used to attach the bag 306 to a surface 702 such that spent sheets can easily be placed within the bag 306.

Turning back to FIG. 6, in on embodiment the written instructions 601 can include an instruction 605 for using the attachment device 604. For example, the instruction 605 may read, "USE ADHESIVE TO ATTACH TO SURFACE." Other instructions will be obvious to those of ordinary skill in the art having the benefit of this disclosure.

While written instructions 601 are optional, it can be advantageous to include them on the outer surface of the bag 306. The written instructions 601 provide a written protocol instructing the user how to properly dispose of the spent sheets, how to use the bag, and/or how to use the attachment device 604.

In one embodiment, the bag 306 includes a sufficient interior volume for every sheet disposed within the package 101 to be placed within the bag 306 when spent. However, in other embodiments, the interior volume of the bag 306 is only sufficient for a subset of the sheets to be placed within the bag 306. Where this is the case, multiple bags can be placed within the package. Such an embodiment is shown in FIG. 8.

Figure 8:
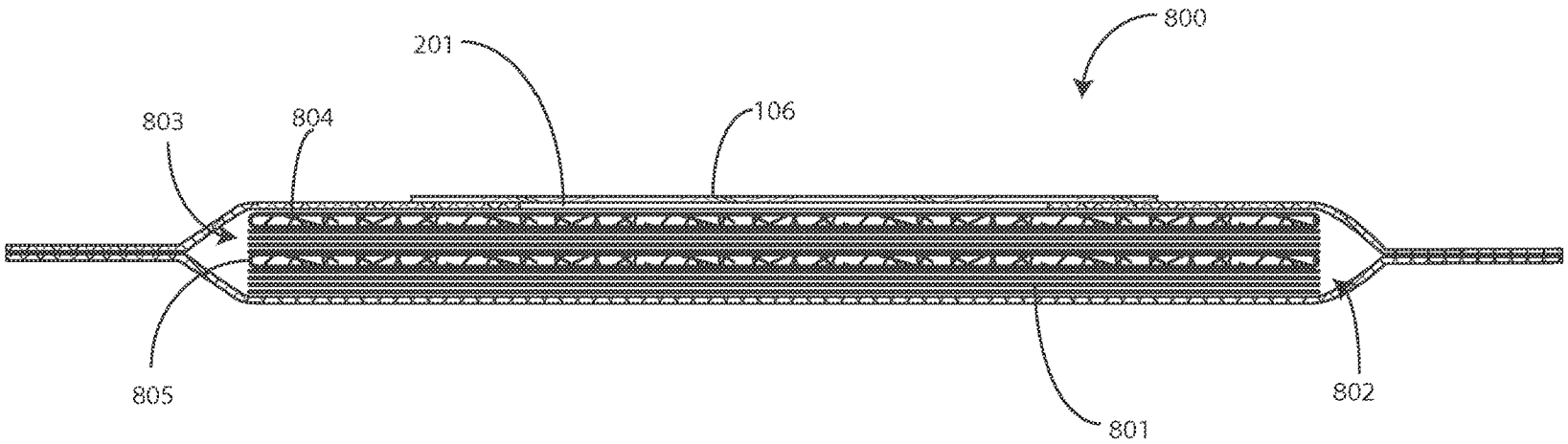
FIG. 8 illustrates another explanatory assembly in accordance with one or more embodiments of the disclosure.

Turning now to FIG. 8, illustrated therein is another sheet package assembly 800 in accordance with one or more embodiments of the disclosure. As with the sheet package assembly (300) of FIG. 3, the sheet package assembly 800 of FIG. 8 includes a plurality of sheets 801. Rather than being arranged in a single stacked configuration (302), as was the case in FIG. 3, the plurality of sheets 801 is arranged in a first stacked configuration 802 and a second stacked configuration 803.

The sheet package assembly 800 also includes one or more bags that provide a disposal receptacle for spent sheets. In this illustrative embodiment, the sheet package assembly 800 includes a first bag 804 and a second bag 805. Each bag 804,805 has an interior volume suitable to receive spent sheets from a corresponding stacked configuration 802,803. For example, if the first stacked configuration 802 includes four sheets, the interior volume of the first bag 804 would be large enough to receive four sheets. The same is true for the second bag 805. It would have an interior volume suitable to receive the sheets from the second stacked configuration 803.

Thus, when a user peels back the aperture sealing label 106, the first bag 804 is revealed. The user withdraws the first bag 804 from the package and then accesses the first stacked configuration 802. As those sheets are used, they are placed in the first bag 804. Once the first stacked configuration 802 is spent, the user may dispose of the first bag 804.

The second bag 805 then becomes visible. The user withdraws the second bag 805 from the package and accesses the second stacked configuration 803. As those sheets are used, they are placed in the second bag 805. Once the second stacked configuration 803 is spent, the user may dispose of the second bag 805.

Thus, as shown in FIG. 8 the sheet package assembly 800 includes a first bag 804 to receive spent sheets from a first stacked configuration 802 and a second bag 805 to receive additional sheets from a second stacked configuration 803. The first bag 804 is disposed within the package between the aperture 201 and the first stacked configuration 802. The second bag is disposed between the first stacked configuration 802 and the second stacked configuration 803.

Advantageously, the configuration of FIG. 8 allows bags to be disposed of with a fewer number of sheets. Thus, if the sheets have an off odor or other unpleasant sensory characteristic after use, they may be disposed of more quickly with the inclusion of additional bags within the package. While two bags are placed within the package of FIG. 8, three, four, or more bags could be included based upon the size of the package and the number of sheets. Other configurations will be obvious to those of ordinary skill in the art having the benefit of this disclosure.

Figure 9:
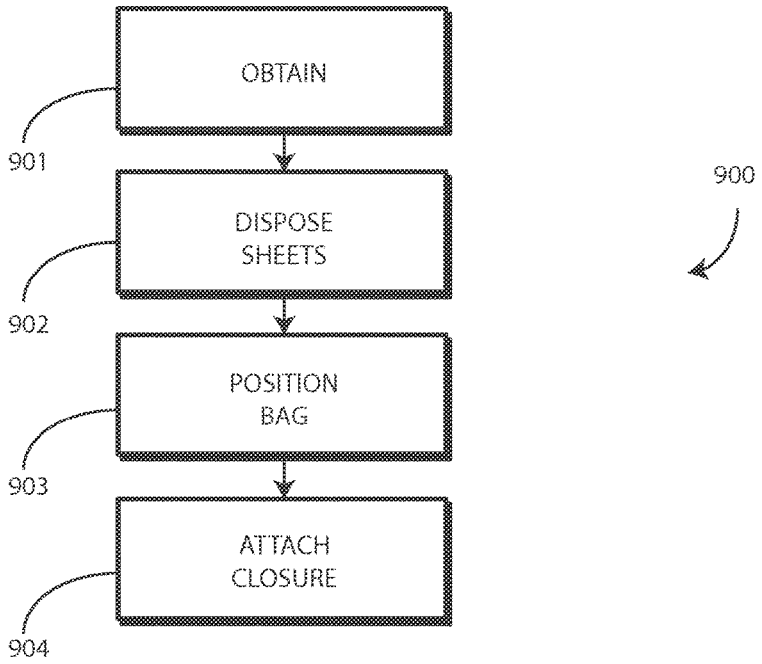
FIG. 9 illustrates one explanatory assembly in accordance with one or more embodiments of the disclosure.

Turning now to FIG. 9, illustrated therein is a method 900 for manufacturing a sheet package assembly. At step 901, the method 900 includes obtaining a package. In one embodiment, the package comprises an outer surface having a major face defining an aperture.

At step 902, the method includes disposing a plurality of sheets in the package. In one embodiment, the sheets are arranged in a stacked configuration. In other embodiments, the sheets can be in a rolled configuration, loose configuration, or other configurations.

At step 903, the method 900 includes positioning a bag between the plurality of sheets and the aperture of the package. In one embodiment, the bag is to receive spent sheets for disposal.

At step 904, the method 900 includes attaching an aperture sealing label to the outer surface of the package. In one embodiment, the aperture sealing label is attached to the package so that the aperture and at least a portion of the bag inserted at step 903 are concealed by the aperture sealing label. However, in one or more embodiments the aperture sealing label is selectively removable from the package by way of a releasable adhesive. Accordingly, the aperture sealing label can selectively attach to the outer surface to close the aperture, while also being selectively peelable from the outer surface to expose the aperture and the bag.

Figure 10:
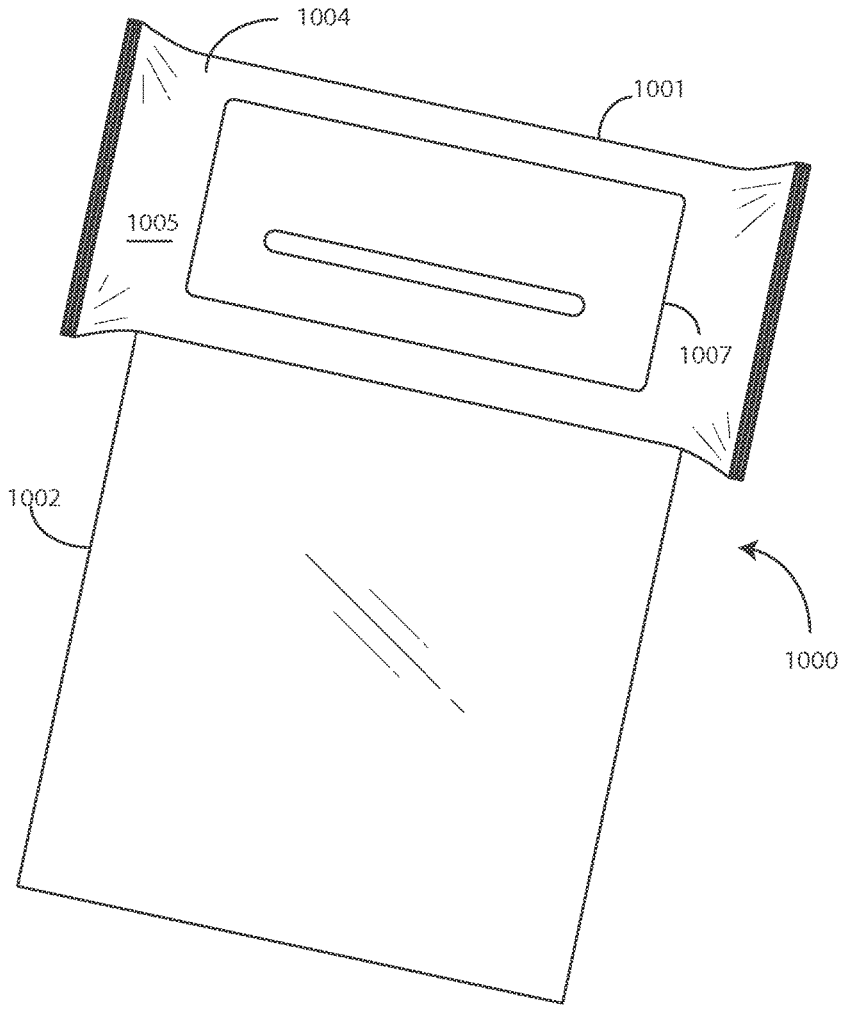
FIG. 10 illustrates another explanatory assembly in accordance with one or more embodiments of the disclosure.
Figure 11:
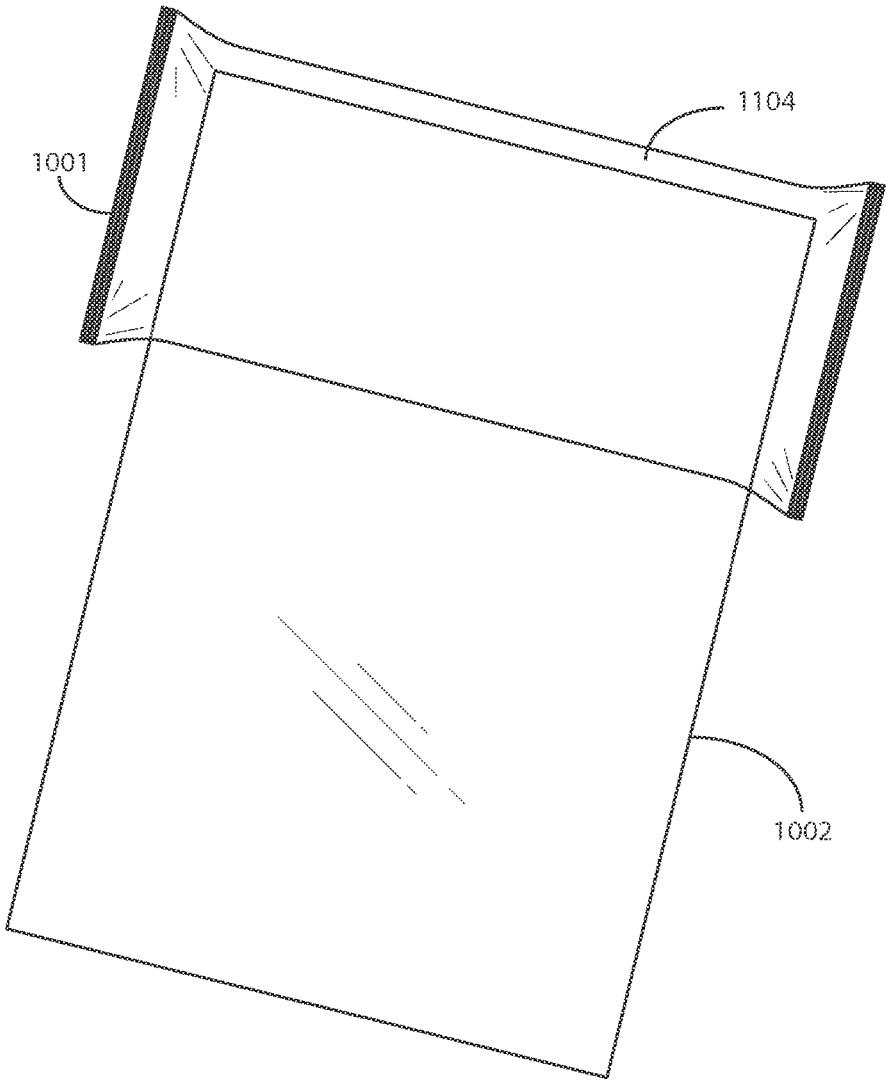
FIG. 11 illustrates another explanatory assembly in accordance with one or more embodiments of the disclosure.

To this point, the bag has been placed within the package so that it is the first thing seen when the aperture sealing label—or other closure as the case may be—is peeled back to reveal the aperture. However, embodiments of the disclosure are not so limited. Turning now to FIGS. 10-11, illustrated therein is an alternate embodiment of the disclosure.

As best shown in FIG. 10, a sheet package assembly 1000 in accordance with one or more embodiments of the disclosure includes a plurality of sheets as previously described. The plurality of sheets can be configured in a stacked configuration (302) as was the case in FIG. 3. However, if briefs or under pads are substituted for the plurality of sheets as noted above, the stacked configuration may only be a stack of one when only one brief or under pad is included in the package 1001.

As with previous embodiments, the sheet package assembly 1000 also includes one or more bags that provide a disposal receptacle for spent sheets. However, rather than being disposed along an interior compartment of the package 1001 as in the previously described embodiments, in this illustrative embodiment the bag 1002 is attached to an outer surface of the package 1001. Accordingly, the bag 1002 can be folded down from the package to provide a convenient receptacle for spent sheets.

In this illustrative embodiment, the package 1001 defines an outer surface 1004 having a major face 1005 defining an aperture (1206). As before, an aperture sealing label 1007 is to selectively attach to the outer surface 1004 of the package 1001 to close the aperture (1206). The aperture sealing label 1007 is also selectively peelable from the outer surface to expose the aperture (1206) as well.

Figure 12:
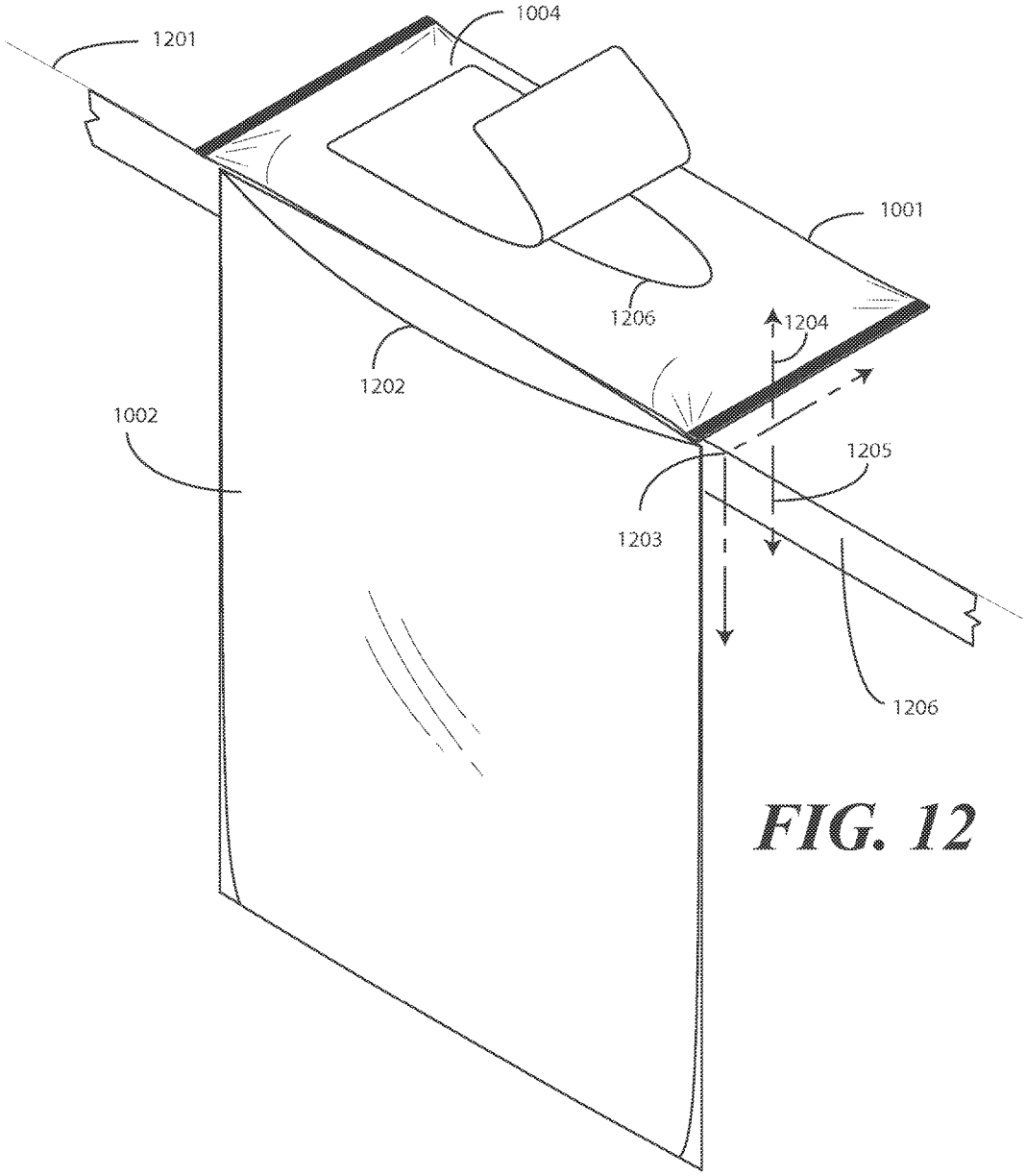
FIG. 12 illustrates another explanatory assembly in accordance with one or more embodiments of the disclosure.

The bag 1002 is to receive spent sheets for disposal. In this embodiment, the bag 1002 is attached to the outer surface 1104 of the package. In this embodiment, the major face 1005 along which the aperture (1206) is disposed defines a top of the package 1001. The bag 1002 is attached to another major face 1105 defining a bottom of the package 1001. As shown in FIG. 12, this allows the package 1001 to be placed on a cornered surface 1201 with the bag 1002 hanging down at an orthogonal angle from the package 1001.

In one embodiment, the bag defines an opening 1202. When placed on a cornered surface 1201 as shown in FIG. 12, the package 1001 and bag 1002 are folded to an orthogonal angle 1203 with the outer surface 1004 defining the top of the package 1001 disposed exterior 1204 to the orthogonal angle 1203. The outer surface (1104) defining the bottom of the package 1001 is disposed interior 1205 to the orthogonal angle 1203. The opening 1202 is disposed on the top side of the bag 1002. Accordingly, the opening 1202 is disposed exterior 1204 to the orthogonal angle 1203 in this configuration, and is easily accessible to a user. Adhesive tape 1207, or another fastening device, can be used to retain the bag 1002 to the cornered surface 1201. A user can easily remove product from the aperture 1206, and can then dispose the product in the bag 1002 without having to move, fold, bend, open, or otherwise alter the orthogonal configuration of FIG. 12. The bag 1002 can then be disposed of easily and hygienically.

In one or more embodiments, the bag 1002 is colored. Alternatively, it can have pictures or other artistic indicia thereon. Including colors, text, or other artistic indicia gives the bag an aesthetically pleasing outward appearance. Additionally, a printed outward appearance conceals spent sheets disposed within the bag.

In one or more embodiments, the bag 1002 is detachable from the package 1001. This allows a user to selectively use the sheet package assembly 1000 as shown in FIG. 12. Alternatively, they can detach the bag 1002 from the package 1001 to use the product in a manner of their choosing.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims of this application and all equivalents thereof.

What is claimed is:

1. A sheet package assembly, comprising:

a plurality of sheets arranged in a stacked configuration;

a package comprising an outer surface having a major face defining an aperture;

an aperture sealing label to selectively attach to the outer surface to close the aperture and to be selectively peelable from the outer surface to expose the aperture; and a bag to receive spent sheets for disposal, the bag comprising an instruction not to flush the bag down a toilet, the bag comprising:

an adhesive attachment device to couple the bag to a surface, wherein the adhesive attachment device is wider than the bag; and an adhesive closure allowing the bag to be sealed, wherein the adhesive closure is narrower than the adhesive attachment device;

the plurality of sheets are arranged in the stacked configuration within the package; and the bag is positioned between the stacked configuration and the aperture of the package.

2. The sheet package assembly of claim 1, wherein the bag comprises a disposable bag.

3. The sheet package assembly of claim 2, wherein when the aperture sealing label is peeled from the outer surface to expose the aperture, at least a portion of the sealable bag is visible through the aperture.

4. The sheet package assembly of claim 3, wherein the sealable bag is folded.

5. The sheet package assembly of claim 4, wherein the sealable bag comprises written instructions for using the sealable bag disposed thereon.

6. The sheet package assembly of claim 1, wherein the instruction is DO NOT FLUSH.

7. The sheet package assembly of claim 5, wherein the written instructions comprise another instruction to dispose sheets within the sealable bag.

8. The sheet package assembly of claim 2, the sealable bag further comprising another instruction for use of the adhesive attachment device.

9. The sheet package assembly of claim 8, the adhesive attachment device comprising an adhesive tape.

10. The sheet package assembly of claim 7, wherein the sealable bag is opaque.

11. The sheet package assembly of claim 7, wherein each sheet is pre-moistened.

12. The sheet package assembly of claim 7, wherein each sheet is non-dispersable.

13. The sheet package assembly of claim 12, each sheet is manufactured from one of needlepunched material or spunlace material.

14. The sheet package assembly of claim 1, further comprising:

a second plurality of sheets arranged in a second stacked configuration;

a second bag to receive additional spent sheets for disposal; and the second bag is disposed between the stacked configuration and the second stacked configuration.

* * * * *